United States Patent [19]

Gibson, III et al.

[11] Patent Number: 4,926,092

[45] Date of Patent: May 15, 1990

[54] STEM WITH MOLDED BACK-FILL GAS DIRECTIONAL DIFFUSER

[75] Inventors: Ray G. Gibson, III, Bath; Albert E. Kowal, Corning, both of N.Y.

[73] Assignee: North American Philips Corporation, New York, N.Y.

[21] Appl. No.: 251,629

[22] Filed: Sep. 29, 1988

[51] Int. Cl.[5] ..... H01J 61/30; H01J 61/35; H01J 61/42; H01K 3/22

[52] U.S. Cl. ..... 313/493; 313/623; 313/634; 220/2.2

[58] Field of Search ..... 313/634, 626, 493, 623; 220/2.2

[56] References Cited

U.S. PATENT DOCUMENTS

| | | | |
|---|---|---|---|
| 1,611,044 | 12/1926 | King et al. | 220/2.2 X |
| 2,279,907 | 4/1942 | Atchley, Jr. | 313/493 X |
| 2,699,514 | 1/1955 | Cox et al. | 220/2.2 X |
| 3,783,322 | 1/1974 | Anthony | 313/42 |

FOREIGN PATENT DOCUMENTS 963474 7/1960 United Kingdom .

OTHER PUBLICATIONS

English abstract of Japanese Appl. No. 56-105002, Jan. 1983.

*Primary Examiner*—Palmer C. DeMeo
*Attorney, Agent, or Firm*—Brian J. Wieghaus

[57] ABSTRACT

A lamp stem having integral glass structure for controlling gas flow into the lamp outer envelope of an electric lamp during back-fill. The lamp stem having a protrusion adjacent the stem press through which a conduit connected to the exhaust tube extends with a curved profile. The end portion of the conduit extends in the direction of the stem skirt and defines an acute angle with the exhaust tube. The end portion is angled for directing the gas flow during back-fill away from coated portions of the lamp envelope in which the stem is sealed. The conduit may have a cross-sectional area which increases in the direction of the gas flow so that the conduit functions as a gas diffuser for reducing the velocity of the gas in addition to directing the gas flow in a desired direction. In an alternative embodiment, the conduit terminates adjacent the stem press. A glass portion integral with the stem extends over the conduit opening and has a concave surface facing the opening for deflecting the gas flow during back-fill away from portions of a lamp envelope having a coating.

17 Claims, 3 Drawing Sheets

STEM WITH MOLDED BACK-FILL GAS DIRECTIONAL DIFFUSER:

BACKGROUND OF THE INVENTION

The present invention relates to lamp structure for controlling gas flow into the lamp outer envelope of an electric lamp during back-fill. The invention further relates to a lamp where such structure is an integral part of the lamp stem.

In electric lamps, the lamp stem extends into the interior space of the lamp outer envelope. An exhaust tube is connected to the lamp stem and communicates with the interior of the lamp envelope via a conduit through the stem wall. During the manufacture of electric lamps, the exhaust tube is used to evacuate the lamp envelope and to back-fill the lamp envelope with a predetermined gas. During the back-fill operation, the gas flows from a gas source through the exhaust tube and conduit into the interior of the lamp outer envelope. In the known lamp stems, the conduit has an opening adjacent the stem press and is generally straight. Gas exiting from the conduit during back-fill flows adjacent the stem press and impinges on the side interior wall of the outer envelope.

The interior surface of the outer envelope of electric lamps is often provided with a coating comprising powdered or particulate material. For example, incandescent lamps frequently have a coating or frosting on the inner surface of the lamp envelope to diffuse the light emanating from the filament. The familiar white frosted lamps have a coating of finely powdered white silica. Fluorescent lamps and some types of high pressure discharge lamps, such as metal halide, high pressure sodium and mercury lamps, have a coating of powdered phosphors on the inner surface of the lamp envelope. The phosphors convert ultraviolet radiation into visible light and modify the color rendition of the lamps.

In lamps having a coating on the interior of the lamp outer envelope, flow from the stem conduit as described above can have a velocity such that the gas impinges on the coating and loosens or blows the coating material off the wall. The thickness of the coating is then reduced or completely removed from a section of the envelope wall. The damaged coating will adversely affect appearance and possibly lamp performance. Such damaged lamps must then be rejected.

A solution to this problem has been to deflect the gas away from the envelope coating. In one arrangement, a metal shield is positioned over the opening of the conduit at an angle sufficient to deflect the gas flow away from the portion of the lamp envelope having the powdered or particulate coating. The metal shield is supported by a wire welded to the shield and to one of the lamp current supply conductors. Alternatively, U.S. Pat. No. 3,783,322 discloses a disc shaped metal heat shield which straddles the stem press and is positioned to deflect the gas away from the coating. However, these solutions require extra metal parts and additional manufacturing steps to attach the parts to the stem press or current-supply conductors, and add to the cost of the lamp. Moreover, the gas deflectors in the assembled lamps are frangible and are susceptible to vibration and shock damage.

Japanese Application No. 56-105002 discloses a lamp stem having a conventionally formed conduit for the exhaust tube which is further enlarged by drilling along the axis of the stem. The stem press has a concave portion circumscribing the drilled portion of the exhaust hole. The drilled portion of the exhaust hole and the curved stem press allows gas to flow into the envelope at an angle closer to the lamp axes than in conventional stems. However, gas flowing through the exhaust hole is directed toward the rounded end of the lamp envelope opposite the lamp stem which is an area normally provided with a coating. Additionally, the gas flow would impinge on the filament and possibly be deflected onto the coating on the side of the lamp envelope. Moreover, this stem requires the additional manufacturing step of drilling the glass stem.

SUMMARY OF THE INVENTION

It is an object of the invention to provide gas flow control structure for directing the gas flow from the conduit away from the portion of the lamp envelope provided with a coating and which structure does not require additional parts and is easy to manufacture.

It is another object of the invention to provide gas flow control structure which, in addition to directing the gas flow from the conduit, acts as a gas diffusor for reducing the velocity of the gas flowing out of the conduit during back-fill.

It is a further object of the invention to provide gas flow control structure as described above which is integral with the lamp stem.

The lamp stem according to the invention has a tubular body, a press seal at one end of the body which defines a stem press, and a flared skirt at the open end of the body. An exhaust tube extends through the tubular body and is fused to the stem at a thickened wall portion in the area of the stem press. A conduit extends from the exhaust tube through the thickened wall portion.

When assembled in a lamp, the stem extends into the interior portion of the outer envelope and the skirt is sealed to the outer envelope in a gas tight manner. The exhaust tube communicates with the interior space of the outer envelope via the conduit. Current supply conductors extend through the stem press and are connected to a light source arranged within the outer envelope.

In a first embodiment of the invention, the lamp stem has a glass protrusion extending from the thickened wall portion of the tubular stem proximate the stem press. The conduit extends from the exhaust tube through the thickened wall portion and the protrusion with a curved profile such that its end portion extends in the direction of the flared skirt. The portion of the conduit extending in the direction of the flared skirt forms an acute angle with the exhaust tube. When sealed in a lamp outer envelope having a coating on its inner wall, the conduit is angled to direct the gas flowing out of the conduit in the direction of the flared skirt such that during the back-fill operation the gas flow from the conduit does not impinge on the coating. The conduit has generally a constant cross-sectional area.

In a second embodiment, the lamp stem has a glass protrusion as in the first embodiment but the cross-sectional area of the conduit increases as the conduit extends from the exhaust tube through the protrusion. The conduit then functions as a gas diffusor to decrease the velocity of the gas in addition to directing the gas flow in a desired direction away from the outer envelope coating.

In a third embodiment, the conduit terminates at the outer surface of the thickened wall portion adjacent the stem press with its axis at a small angle with respect to the stem press. The lamp stem has a glass portion with a surface that extends over the opening of the conduit and faces the conduit. The facing surface is positioned with respect to the opening such that the gas flowing from the conduit impinges on the surface and is deflected away from the outer envelope wall. The facing surface is angled such that the velocity of the impinging gas is decreased while deflecting the gas in a direction such that it does not impinge on the coating of the lamp envelope to which the stem is sealed.

The protrusion of the first embodiment and the glass portion of the third embodiment can be formed during manufacturing when the exhaust tube, pinch seal and conduit are formed. This reduces manufacturing costs as additional steps for making a metallic shield and attaching the shield to the stem are eliminated. Moreover, the stems according to the invention eliminate rejects and lamp failures due to breakage of metallic shield assemblies as in the prior art since there are no attached parts that can be dislodged during manufacturing and during lamp usage.

DESCRIPTION OF THE PREFERRED EMBODIMENTS

Figure 1:
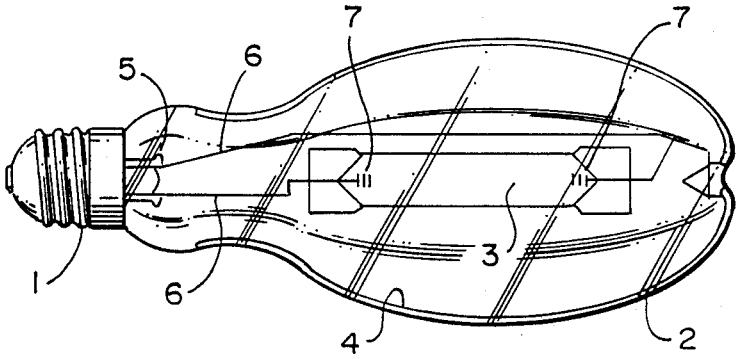
FIG. 1 is a side view of a high pressure discharge lamp.

FIG. 1 shows a high pressure discharge lamp having a lamp cap 1 connected to an outer envelope 2 in which a discharge device 3 is disposed. Current supply conductors 6 are connected to respective electrodes 7 and extend through the lamp stem 5 where they are connected to respective portions of the lamp cap. The outer envelope 2 has a coating 4 on its inner surface for converting ultraviolet radiation from the discharge device 3 into visible light. The coating 4 terminates at a predetermined distance from the lamp cap.

Figure 2:
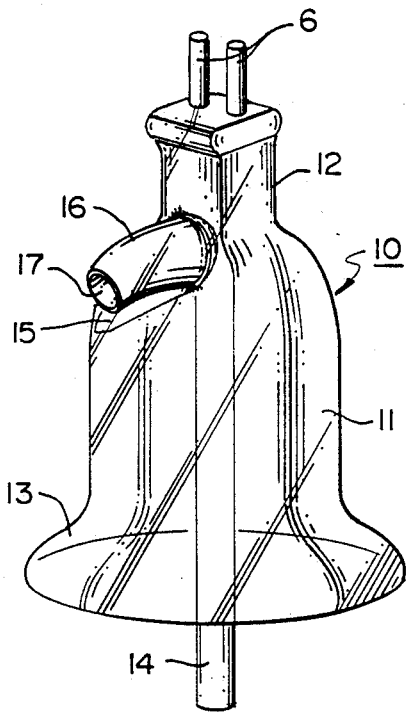
FIG. 2 is an isometric view of a lamp stem of a first embodiment of the invention.
Figure 3:
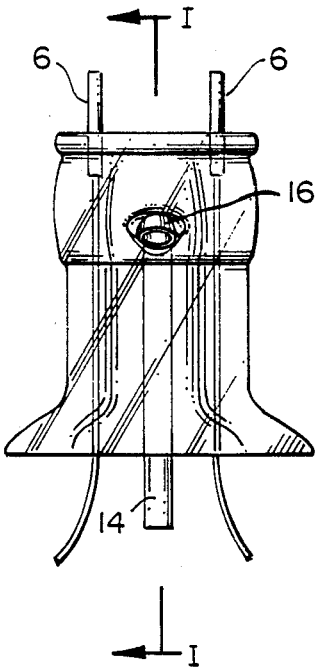
FIG. 3 is a front view of the lamp stem shown in FIG. 2.
Figure 4:
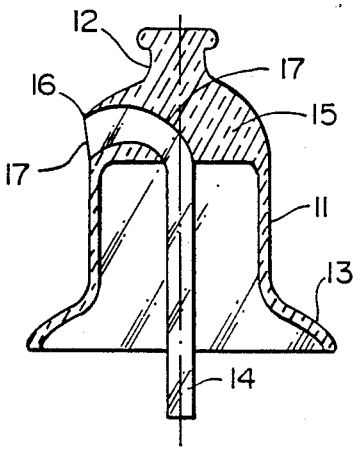
FIG. 4 is a section view of a lamp stem as seen on the line I—I in FIG. 3, according to the second embodiment of the invention in which the cross-sectional area increases in the direction away from the exhaust tube.

In FIGS. 2–4, the lamp stem 10 according to the first embodiment has a tubular portion 11, a stem press 12, and a flared skirt 13. When assembled in a lamp, the flared skirt 13 is sealed to the outer envelope in a gas-tight manner. The sealed stem defines a reentrant portion of the lamp envelope. The exhaust tube 14 extends within the tubular portion 11 and is fused to the stem at a thickened wall portion 15. A glass protrusion 16 is integral with the lamp stem and extends from the thickened wall portion 15 adjacent the stem press 12. A conduit 17 extends from the exhaust tube through the thickened wall portion and extends through the protrusion 16 with a curved profile. The end portion of the conduit extends in the direction of the flared skirt and forms an acute angle $\alpha$ with the exhaust tube 14. The angle $\alpha$ is chosen so that when the stem is sealed in a lamp outer envelope having a coating on its inner surface the gas flowing out of the conduit during the back-fill operation does not impinge on the coating. For example, if the lamp stem 10 were sealed in the envelope 2 of the discharge lamp of FIG. 1, the conduit 17 would be angled to direct the gas flow so that it impinges on the uncoated portion of the outer envelope.

The conduit 17 in the lamp stem according to the first embodiment of the invention has a generally constant cross sectional area. It may be preferable to reduce the velocity of the gas flow exiting from the conduit in addition to changing its direction. In a second embodiment, the conduit is formed such that its cross sectional area increases in a direction progressively closer to the opening of the conduit 17. (FIG. 4) Thus, during back-fill the cross-sectional areas increases progressively downstream. The conduit then functions as a gas diffuser to decrease the velocity of the gas in addition to directing the gas flow in a desired direction.

Figure 5:
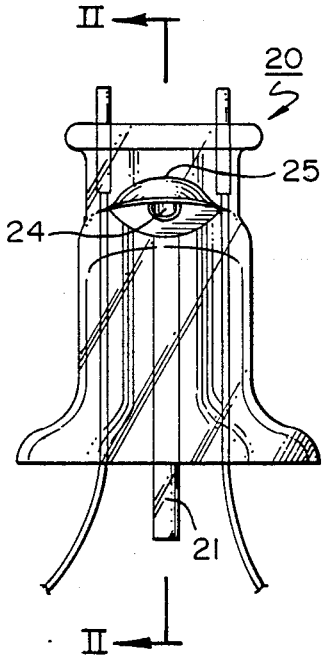
FIG. 5 is a front view of a third embodiment of the invention.
Figure 6:
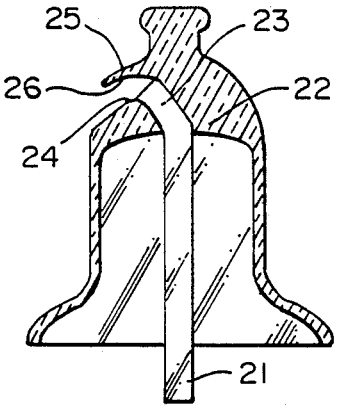
FIG. 6 is a sectional view of the lamp stem shown in FIG. 5 as seen on line II—II in FIG. 5.

FIGS. 5 and 6 show a front view of a lamp stem 20 of a third embodiment. The exhaust tube 21 extends through the tubular portion of the lamp stem and is fused to a thickened wall portion 22. A conduit 23 extends from the exhaust tube through the thickened wall portion 22 and terminates at an orifice 24 on the stem outer surface. A glass hood-shaped portion 25 integral with the stem extends over the orifice 24 and has a concave surface 26 facing the orifice. The hood-shaped portion 25 merges into the thickened wall portion 22 proximate opposing edges of the orifice 24. The concave surface 26 of the portion 25 is positioned with respect to the orifice such that gas flowing out of the conduit during the back-fill operation impinges on the concave surface and is deflected. The concave surface is angled for decreasing the velocity of the impinging gas and for deflecting the gas in a predetermined direction so that the gas does not impinge on the coating of the outer envelope in which it is sealed.

Figure 7:
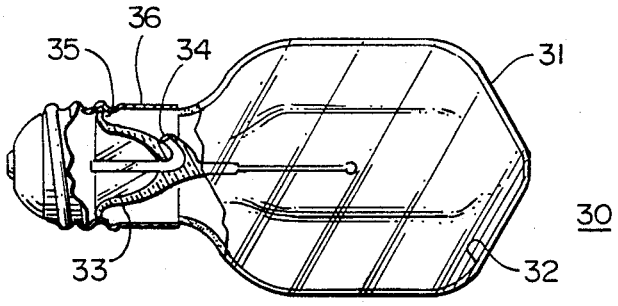
FIG. 7 is a view of an incandescent lamp, partly in section, having a stem according to the first embodiment.
Figure 8:
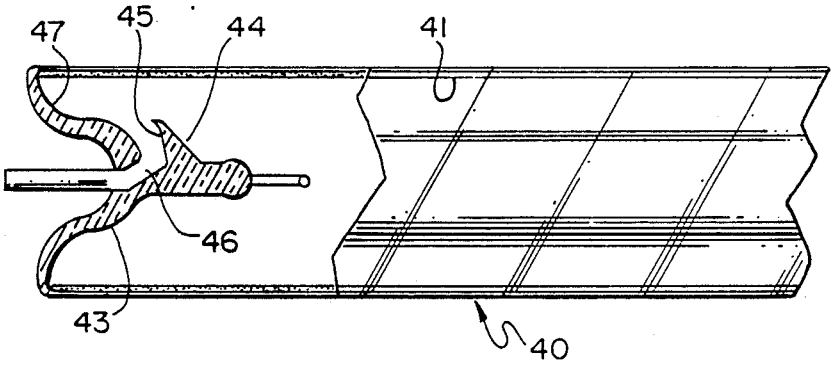
FIG. 8 is a partial view of a fluorescent lamp, partly in section, having a stem according to the third embodiment.

FIGS. 7 shows an incandescent lamp 30 having a lamp envelope 31, silica coating 32, and a lamp stem 33 according to the first embodiment. The lamp stem 33 is positioned such that gas flowing from the curved conduit 34 is directed towards the skirt 35 so that it impinges on the portion 36 of the outer envelope not have a coating. FIG. 8 shows a portion of a low pressure discharge lamp 40 having a fluorescent coating 41 and a lamp stem 43 according to the second embodiment. The cross-section shows that the curved facing surface 45 of the glass hood-shaped portion 44 is positioned to deflect the gas emerging from the conduit 46 in the direction of the skirt 47 and away from the portion of the outer envelope having the fluorescent coating 41.

In order to establish the operability of the stems according to the invention, handblown lamp stems according to the first embodiment were tested against a conventional lamp stem not having a gas deflector. The lamp stems were sealed in conventional high pressure discharge envelopes having an interior coating as shown in FIG. 1. The envelopes with the sealed stems were purged to a pressure of less than $10^{-5}$ atmospheres. The exhaust tubes were then opened to the atmosphere to allow air to flow back into the envelopes through the exhaust tubes. The air flow rate through the exhaust tubes after opening to the atmosphere was greater than the gas flow rate normally found on an assembly line during a back-fill operation. After one purge cycle, envelopes with the standard stem had a region in which the coating appeared thinner due to the coating being blown off by impinging gas. By contrast, envelopes with stems according to the first embodiment displayed regions in which the coating was partially removed by impinging gas only after seven purge and refill cycles.

What is claimed is:

1. A lamp stem, comprising:

a tubular glass body defining a stem axis having an open end, a flared skirt extending from the open end of said tubular body and a stem press defining a closed end of said tubular body, said stem press merging into said tubular body at a thickened wall portion of said body, said tubular body enclosing an interior space between said stem press and said flared skirt;

an exhaust tube extending in the interior space of said tubular body having an end fused to said tubular body at said thickened wall portion, said thickened wall portion having a conduit extending from said exhaust tube end through said thickened wall portion to the exterior of said thickened wall portion; and directing means comprising an integral glass portion of said tubular body for directing a gas passing through said exhaust tube and said conduit in a direction towards said flared skirt at an acute angle relative to said stem axis.

2. A lamp stem as claimed in claim 1, wherein said directing means comprises a glass protrusion protruding from said thickened wall portion, and said conduit extends from said exhaust tube end through said thickened wall portion and said protrusion, said conduit being curved so that a gas passing through said exhaust tube and said conduit exits said conduit in said direction towards said flared skirt.

3. A lamp as claimed in claim 2, wherein the cross-sectional area of said conduit increases in the direction away from said exhaust tube end as it extends through said protrusion.

4. A lamp stem as claimed in claim 2, wherein said stem press has two major opposing surfaces, said protrusion is proximate one of said major surfaces, and the portion of said conduit extending through said protrusion lies in a plane perpendicular to said major surfaces.

5. A lamp stem, comprising:

a tubular glass body defining a stem axis having an open end, a flared skirt extending from the open end of said tubular body and a stem press defining a closed end of said tubular body, said stem press merging into said tubular body at a thickened wall portion of said body, said tubular body enclosing an interior space between said stem press and said flared skirt;

an exhaust tube extending in the interior space of said tubular body having an end fused to said glass wall at said thickened wall portion, said thickened wall portion having a conduit extending from said exhaust tube end through said thickened wall portion and terminating at an orifice on the exterior of said thickened wall portion; and directing means comprising a glass portion having a surface extending over and facing said orifice on which a gas flowing through said exhaust tube out of said conduit impinges, said facing surface being concave and merging with said exterior of said thickened wall portion proximate opposing edges of said orifice, said surface being angled with respect to said conduit for deflecting said gas off said facing surface in said direction towards said flared skirt.

6. A lamp stem as claimed in claim 5, wherein said stem press has two major opposing surfaces, and said orifice and said concave surface of said glass portion is proximate one of said major surfaces and aligned with the center of said one major surface.

7. A lamp stem as claimed in claim 6, wherein said exhaust tube is aligned with the stem axis.

8. In an electric lamp of the type having a lamp envelope with a reentrant stem, a light source arranged within said envelope, and a coating comprising particulates on the inner surface of said envelope extending to within a predetermined distance of said reentrant stem, the improvement comprising:

said reentrant stem comprising a tubular glass body defining a stem axis having an open end, a flared skirt extending from the open end of said tubular body sealed to the reentrant portion of said envelope in a gas-tight manner, and a stem press defining a closed end of said tubular body, said stem press merging into said tubular body at a thickened wall portion of said body, and said tubular body enclosing an interior space between said stem press and said flared skirt;

an exhaust tube extending in the interior space of said skirt having an end fused to said glass body at said thickened wall portion, said thickened wall portion having a conduit extending from said exhaust tube end through said thickened wall portion to the exterior of said thickened wall portion; and directing means comprising an integral portion of said tubular body for directing a gas flowing through said exhaust tube in a direction towards said flared skirt such that said gas does not impinge on said coating.

9. An electric lamp as claimed in claim 8, wherein said conduit terminates at an orifice on the exterior of said thickened wall portion and said directing means comprises a glass portion having a surface extending over and facing said orifice on which said gas impinges, said facing surface being concave and merging with said exterior of said thickened wall portion proximate opposing edges of said orifice, said surface being angled with respect to said conduit for deflecting said gas off said surface in said direction towards said flared skirt.

10. An electric lamp as claimed in claim 9, wherein said stem press has two major opposing surfaces, and said orifice and said concave surface of said glass portion is proximate one of said major surfaces and aligned with the center of said one major surface.

11. An electric lamp as claimed in claim 10, wherein said exhaust tube is aligned with said stem axis.

12. An electric lamp as claimed in claim 8, wherein said directing means comprises a glass protrusion protruding from said thickened wall portion and said conduit extends from said exhaust tube end through said thickened wall portion and said protrusion, said conduit being curved for directing said gas exiting said conduit in said direction towards said flared skirt portion.

13. An electric lamp as claimed in claim 12, wherein the cross-sectional area of said conduit increases in the direction away from said exhaust tube end as it extends through said protrusion.

14. An electric lamp as claimed in claim 12, wherein said planar portion has two major opposing surfaces, said protrusion is proximate one of said major surfaces, and the portion of said conduit extending through said protrusion lies in a plane perpendicular to said major surfaces.

15. An electric lamp as claimed in claim 8, wherein said lamp is an incandescent lamp further comprising a pair of current-supply conductors extending through the interior space of said stem on opposite sides of said exhaust tube and passing longitudinally through said stem press, a filament connected to said current-supply conductors, and said coating comprises particulate silicon.

16. An electric lamp as claimed in claim 8, wherein said lamp is a fluorescent lamp further comprising a pair of current-supply conductors extending through the interior space of said stem and passing longitudinally through said stem press, an electrode connected to said current supply conductors, and said coating comprises a phosphor.

17. An electric lamp as claimed in claim 8, wherein said lamp is a high intensity discharge lamp comprising a pair of current-supply conductors extending through the interior of said stem on opposites sides of said exhaust tube passing longitudinally through said stem press and extending into said lamp envelope, a high pressure discharge device arranged in said envelope connected to said current-supply conductors, and said coating comprises a phosphor.

* * * * *